US010625883B2

(12) United States Patent
Kim et al.

(10) Patent No.: US 10,625,883 B2
(45) Date of Patent: Apr. 21, 2020

(54) AUTO-PACKING APPARATUS FOR POUCH

(71) Applicants: YUHANNCI Co., Ltd., Incheon (KR); AESTURA Corporation, Seoul (KR)

(72) Inventors: Seok tae Kim, Incheon (KR); Jae in Kim, Incheon (KR); Sung woo Lee, Hwaseong-si (KR); Jong myung Park, Suwon-si (KR); Kyu yong Park, Hwaseong-si (KR)

(73) Assignees: YUHANNCI CO., LTD., Incheon (KR); AESTURA CORPORATION, Seoul (KR)

( * ) Notice: Subject to any disclaimer, the term of this patent is extended or adjusted under 35 U.S.C. 154(b) by 267 days.

(21) Appl. No.: 15/653,621

(22) Filed: Jul. 19, 2017

(65) Prior Publication Data

US 2018/0029729 A1 Feb. 1, 2018

(30) Foreign Application Priority Data

Jul. 26, 2016 (KR) ..... 10-2016-0094692
Nov. 25, 2016 (KR) ..... 10-2016-0158095

(51) Int. Cl.

| | |
|---|---|
| ***B65B 5/06*** | (2006.01) |
| ***B65B 57/14*** | (2006.01) |
| ***B65B 57/18*** | (2006.01) |
| ***B65B 35/36*** | (2006.01) |
| ***B65B 3/04*** | (2006.01) |
| ***B65B 43/40*** | (2006.01) |
| ***B65B 39/00*** | (2006.01) |
| ***B65B 7/28*** | (2006.01) |

(Continued)

(52) U.S. Cl.

CPC ..... *B65B 3/04* (2013.01); *B65B 5/061* (2013.01); *B65B 5/101* (2013.01); *B65B 7/28* (2013.01); *B65B 7/2807* (2013.01); *B65B 9/06* (2013.01); *B65B 25/141* (2013.01); *B65B 35/24* (2013.01); *B65B 35/36* (2013.01); *B65B 35/46* (2013.01); *B65B 39/005* (2013.01); *B65B 39/007* (2013.01); *B65B 39/02* (2013.01); *B65B 39/12* (2013.01); *B65B 43/40* (2013.01); *B65B 43/50* (2013.01); *B65B 43/52* (2013.01); *B65B 51/32* (2013.01); *B65B 57/14* (2013.01); *B65B 57/18* (2013.01); *B65B 61/06* (2013.01);

(Continued)

(58) Field of Classification Search

CPC ..... B65B 5/06; B65B 5/061; B65B 5/068; B65B 35/40; B65B 35/46; B65B 39/005; B65B 39/007; B65B 57/10; B65B 57/14

USPC ..... 53/493–498, 542, 247, 248; 221/210, 221/224, 231–238, 265

See application file for complete search history.

(56) References Cited

U.S. PATENT DOCUMENTS 3,766,706 A * 10/1973 Graham ..... B65B 5/061 53/529
5,263,302 A * 11/1993 Hauers ..... B65B 5/101 414/788.3

(Continued)

*Primary Examiner* — Hemant Desai
*Assistant Examiner* — Veronica Martin
(74) *Attorney, Agent, or Firm* — Kile Park Reed & Houtteman PLLC

(57) ABSTRACT

The invention is an auto-packing apparatus for pouch, and comprises: a pouch conveyor 20, a slot magazine 50, a pickup means 60 to pick up the moving pouches 1 on the pouch conveyor 20 and insert them into the slots 51 of the slot magazine 50, a pouch retainer 100 to retain the pouches 1 dropping from the slot magazine 50, a moving means 130 to move one 80 of the side walls 70,80 of the pouch retainer 100 and an opening means 91 to open and close the lower part of the pouch retainer 100 and a controller 180.

5 Claims, 13 Drawing Sheets

(51) Int. Cl.

| | |
|---|---|
| ***B65B 25/14*** | (2006.01) |
| ***B65B 39/02*** | (2006.01) |
| ***B65B 5/10*** | (2006.01) |
| ***B65B 63/02*** | (2006.01) |
| ***B65B 43/52*** | (2006.01) |
| ***B65B 43/50*** | (2006.01) |
| ***B65B 35/24*** | (2006.01) |
| ***B65B 35/46*** | (2006.01) |
| ***B65B 9/06*** | (2012.01) |
| ***B65B 39/12*** | (2006.01) |
| ***B65B 51/32*** | (2006.01) |
| ***B65B 61/06*** | (2006.01) |
| *B65B 51/00* | (2006.01) |
| *B65B 61/00* | (2006.01) |

(52) U.S. Cl.
CPC ..... *B65B 63/022* (2013.01); *B65B 51/00* (2013.01); *B65B 61/00* (2013.01)

(56) References Cited

U.S. PATENT DOCUMENTS

| | | | | |
|---|---|---|---|---|
| 5,813,196 | A * | 9/1998 | Page | B65B 5/067 53/171 |
| 6,446,415 | B1 * | 9/2002 | Tale' | B65B 19/32 53/444 |
| 6,792,736 | B1 * | 9/2004 | Takahashi | B65B 5/103 53/237 |
| 8,997,438 | B1 * | 4/2015 | Fallas | B65G 47/914 414/222.01 |
| 2006/0048486 | A1 * | 3/2006 | Laing | A23L 3/001 53/469 |
| 2011/0232228 | A1 * | 9/2011 | Iwasa | B65B 5/061 53/147 |
| 2016/0031573 | A1 * | 2/2016 | Davis | B65B 35/36 53/147 |

* cited by examiner (a)

(b)

(a)

(b)

(a)

(b)

(a)

(b)

(a)

(b)

AUTO-PACKING APPARATUS FOR POUCH

TECHNICAL FIELD

The present invention relates to an auto-packing apparatus for pouch, and more particularly to an auto-packing apparatus for pouch in which pouches containing drugs, cosmetics, teas and others can be effectively packed in the box.

BACKGROUND ART

Usually, cosmetics can be packed in small pouch for PR and sale promotion, or for easy carrying during the journey. Other products such as drugs, foods, or teas in the type of powder, grains or liquid can be packed in the pouch. The pouch may be packed in the box, and the inner space of the box may be divided into plurality of receiving recesses by the partition. In general, a plurality of pouches are vertically packed in the box or in the receiving recesses of the box as the pouch bundle in which a plurality of pouches are overlapped in the thickness direction of it. In this case, the width of the inner space of box or a receiving recess of box are made not to have sufficient space compared to the total thickness of the pouch bundle to be packed to prevent the pouch bundle from shaking or moving.

Conventionally, the work of pouch packing into the box is carried out manually, so the pouch packing is cumbersome and of low productivity. That is, the workers should pick up the pouches moving on the conveyor one by one and put them into a box or a receiving recess of the box, which is cumbersome, and some pouches can be missed, and many laborers are needed so the labor cost is increased.

Moreover, as the total thickness of the pouch bundle is almost the same with the thickness of the box or the receiving recess of the box, it is not easy to insert the pouches in the box rapidly, which makes the pouch packing more difficult and time-consuming. And, if the pouches are inserted in the box vertically, which is normal, the contents in the pouch may be driven downward by their own weights, which will result in bulking of the total thickness of the pouch bundle, and sometimes, the total thickness of the pouch bundle can be wider than the width of the inner space of the box or the receiving recess of it. Then, the worker should press the pouch bundle in the thick direction to enforce the pouch bundle into the box. This is not easy. And the worker should arrange the pouch to be aligned in order to insert the box justly, which makes the pouch packing work more troublesome and more time-consuming.

DISCLOSURE

Technical Problem

The present invention is proposed to solve the above problems, and the object of the invention is to provide an auto-packing apparatus for pouch in which the pouch containing the contents such as drugs, cosmetics, teas and others can be effectively packed in the box, and the number of pouch packed in the box can be easily adjusted, and the location of the receiving recess can be easily adjusted to achieve automatic packing process for pouch, and the packing works can be easy, and labors and times can be saved, and jamming of the pouches during the packing pouch into the box can be prevented to achieve high productivity.

Technical Solution

According to an aspect of the present invention, there is provided an auto-packing apparatus for pouch, which can insert pouches 1 with flat shape into a receiving recess 3 of the box 2, wherein the apparatus comprises:

a pouch conveyor 20 which conveys pouches 1;

a slot magazine 50 disposed on one side of the pouch conveyor 20 and above a supplied box 2 and having a plurality of slots 51 on the upper surface into which the pouches 1 can be inserted vertically;

a pickup means 60 disposed on the other side of the pouch conveyor 20 to pick up the moving pouches 1 on the pouch conveyor 20 and insert them into the slots 51 of the slot magazine 50;

a pouch retainer 100 disposed between the slot magazine 50 and the box 2 and having side walls 70,80 surrounding the slot magazine 50 and a movable bottom plate 90 to open and close the lower part of the pouch retainer 100 to retain the pouches 1 dropping from the slot magazine 50;

a moving means 130 to move one 80 of the side walls 70,80 of the pouch retainer 100 or other moving plate horizontally to press the pouch bundle B consisting of a plurality of aligned pouches 1 in the thickness direction;

an opening means 91 to slide or swing the movable bottom plate 90 to open and close the lower part of the pouch retainer 100; and a controller 180 to control the operation of the moving means 130 and the opening means 91.

According to an aspect of the present invention, there is provided an auto-packing apparatus for pouch, wherein the apparatus further comprises:

a fixing plate 30 disposed on the side of the pouch conveyor 20 and above the supplied box 2 and having a pouch passing hole 31 on the surface of it, and the pouch retainer 100 being attached under the pouch passing hole 31 of it;

a turn table 40 disposed on the fixing plate 30 and having a plurality of openings 41 on which the slot magazines 50 are mounted, the openings 41 being aligned with the pouch passing hole 31 of the fixing plate 30 when the turn table 40 is turned;

a box supplier supplying the box 2 so that the receiving recess 3 of the box 2 is aligned with the pouch retainer 100.

According to an aspect of the present invention, there is provided an auto-packing apparatus for pouch, wherein the pouch retainer 100 has the first sensors 110,111 detecting whether the pouch 1 is inserted in the pouch retainer 100 and whether the inserted pouch 1 is exhausted from the pouch retainer 100, or the second sensors 120,121 detecting whether the pouch 1 is regularly inserted in the slot 51 of the slot magazine 50.

According to an aspect of the present invention, there is provided an auto-packing apparatus for pouch, wherein the receiving recesses 3 of the box 2 are partitioned by the partition wall 5, and the box supplier further includes the box location adjusting means 170 to adjust the location of the receiving recess 3 of the box 2 to be aligned with the pouch retainer 100.

Advantageous Effect

According to the present invention, as the apparatus comprises an automatic machine which includes a pickup means 60 to pick up pouches 1 and insert them in the receiving recess 3 of the box 2, a slot magazine 50, a pouch retainer 100, a moving means 130, an opening means 91 and controller 180, the pouches 1 can be automatically packed in the box 2, so the packing works become easy, labor-saving, and time-saving, so the productivity can be enhanced.

Particularly, as a plurality of pouches 1 are accommodated in the pouch retainer 100 in the form of pouch bundle B and are pressed in the thickness direction before dropping into the receiving recess 3 of the box 2, the problem that the lower part of the pouches 1 is bulked due to the weight of the contents and the total thickness (a) of the pouch bundle B becomes larger than the width (b) of the receiving recess 3 of the box 1, so the pouches 1 would not be easily inserted in the receiving recess 3 of the box 1 could be solved.

And, as a plurality of slot magazines 50 are mounted on the turn table 40, and the turn table 40 is disposed on the fixing plate 30, and the pouch retainer 100 is disposed below the fixing plate 30, the pickup process and the pouch inserting process can be automatically and continuously implemented, so the productivity can be more increased.

And as the pouch retainer 100 has the first sensors 110,111 detecting whether the pouch 1 is inserted in the pouch retainer 100 and whether the inserted pouch 1 is exhausted from the pouch retainer 100, delay of subsequent step due to remaining pouch 1 in the pouch retainer 100 can be prevented, and the generation of packing failure can be reduced. And as the invention has the second sensors 120,121 detecting whether the pouch 1 is irregularly inserted in the slot 51 of the slot magazine 50, interruption of packing process due to irregular packing can be prevented, and packing failure can be reduced.

And, in case the inner space of the box 2 is partitioned by the partition wall 5 into a plurality of receiving recesses 3, the location of box 2 can be adjusted for the receiving recess 3 to be aligned with the position right below the pouch retainer 100, so the pouches can be rapidly and efficiently packed in the box 2. In addition, in case the pouches 1 are to be inserted in some of all the slots 51 of the slot magazine 50, the opening of the bottom plate 90 of the pouch retainer 100 and the location of the box 2 can be adjusted according to pouch's position on the slot magazine 50, number of pouch, and size of the receiving recess 3 of the box 2. As a result, escape of the pouch 1 from the receiving recess 3 of the box 2 can be prevented, so automatic packing process can be effectively carried out for various number of pouch 3 for various size of the box 2.

DETAILED DESCRIPTION OF THE INVENTION

Figure 1:
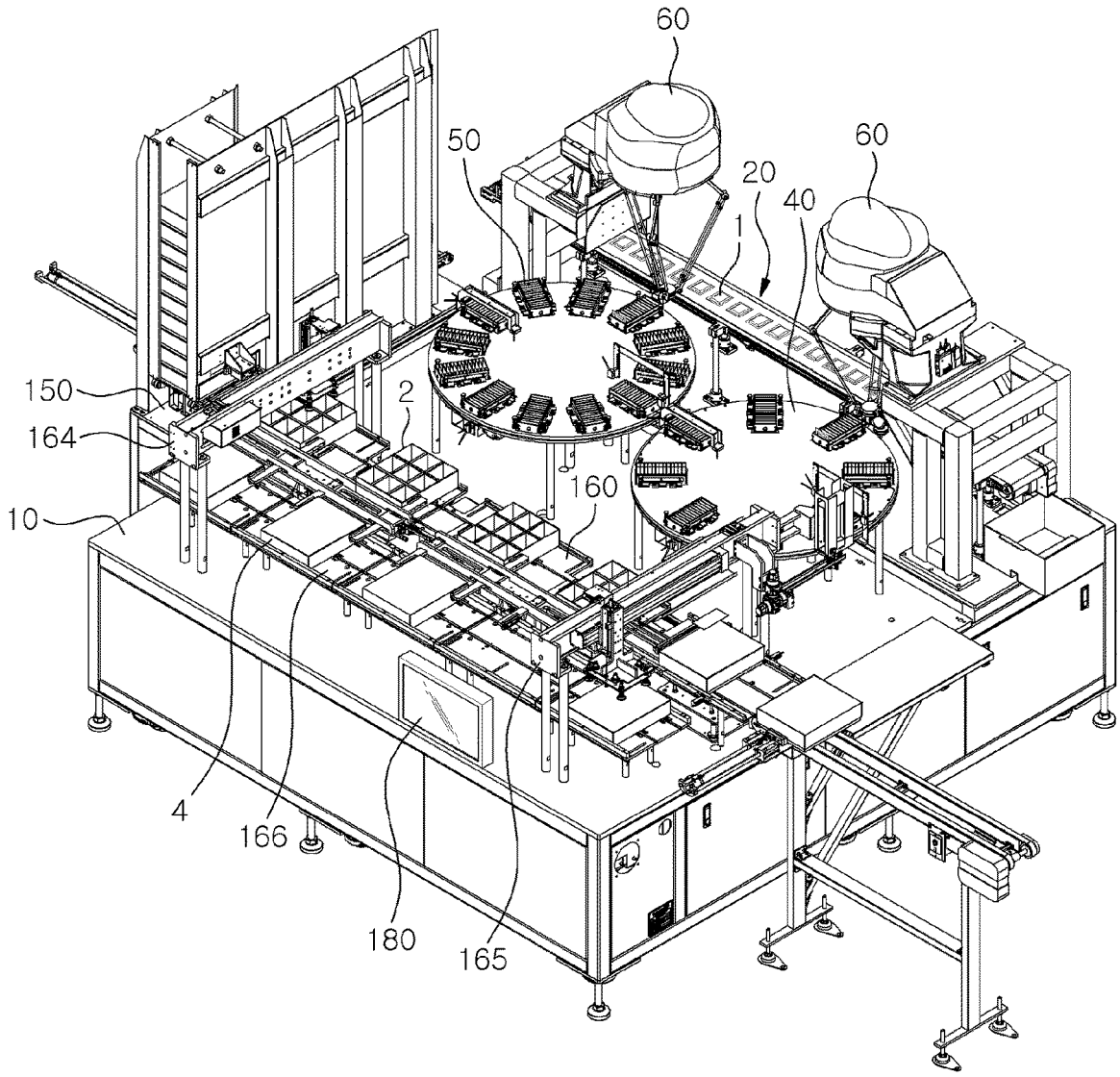
FIG. 1 is a perspective view of one embodiment of the invention

Hereinafter, the preferred embodiments of the invention will be described with reference to the drawings. FIGS. 1 to 11 show one embodiment of the present invention. As shown, the auto-packing apparatus of the invention is a device to insert pouch 1 into the receiving recess 3 of the box 2. The pouch 1 is flat pack containing drugs, cosmetics, tea, or foods in the type of powder, grain or liquid. Tea bag is also a kind of pouch. The invention includes a pouch conveyor 20, a fixing plate 30, a turn table 40, slot magazines 50, a pickup means 60, a pouch retainer 100, a moving means 130, an opening means 91, the first sensors 110,111, the second sensors 120,121, a remaining amount sensor 140,141, a box supplier and a controller 100. The inner space of the box 2 is partitioned by partition walls 5 into a plurality of receiving recesses 3.

The pouch conveyor 20 extends along one side of the apparatus and conveys the pouches 1, and is preferably made of feeding belt and is installed on the base plate 10 as shown in FIG. 1.

The fixing plate 30 is installed on the base plate 10 via supporting legs 32 beside the pouch conveyor 20. The fixing plate 30 is preferably shaped of disc corresponding to the turn table 40. One or more pouch passing holes 31 are formed on the fixing plate 30. Preferably, single passing hole 31 is formed on the peripheral part of the fixing plate 30 opposite to the pouch conveyor 20. In FIG. 1, a pair of fixing plates 30 are installed on the base plate 10 along the conveyor 10 to increase packing speed.

Figure 3:
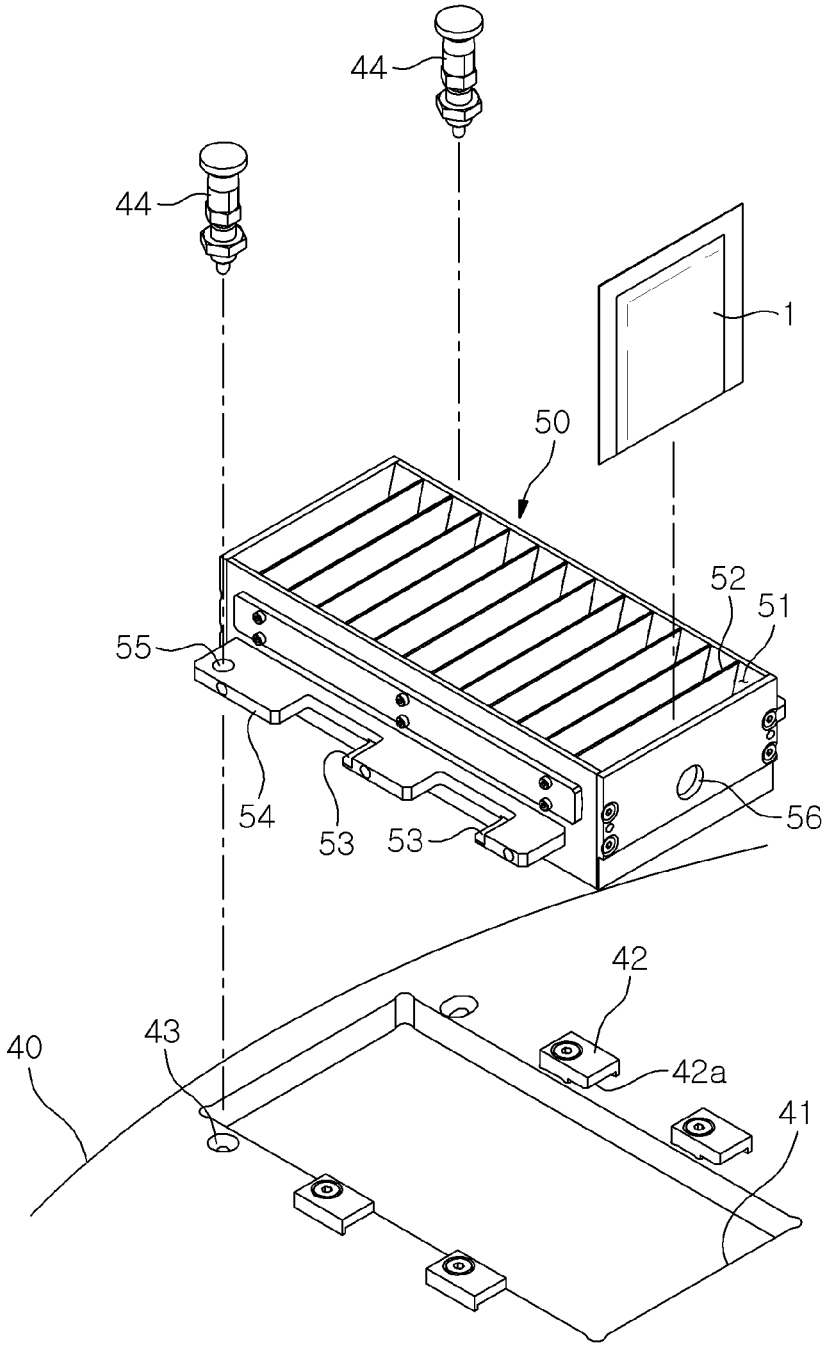
FIG. 3 is an exploded view of the slot magazine according to the invention

The turn table 40 is installed on the fixing plate 30 coaxially. A plurality of openings 41 are formed on the turn table 40 along the peripheral part of it. The openings 41 are aligned with the pouch passing hole 31 of the fixing plate 30 when the turn table 40 is turned on the fixing plate 30. The openings 41 are formed in the shape corresponding to the pouch passing hole 31. As shown in FIG. 3, fasteners 42 are formed on the edge of the opening 41 to removably fasten the slot magazine 50. A slide recess 42*a* is formed on the lower part of the fastener 42. Holes 43 are formed on the periphery of the opening 41 in which an one-touch locking bar 41 is inserted.

The slot magazine 50 is installed on the opening 41 of the turn table 40. The slot magazine 50 has a plurality of slots 51 formed by the partitions 52 in which the pouches 1 are inserted vertically. Accordingly, as the turn table 40 is turned, the slot magazines 50 are sequentially aligned with the pouch passing hole 31 of the fixing plate 30, so the pouches 1 inserted in the slot magazine 50 are dropped through the opening 41 of the turn table 40 and the pouch passing hole 31 of the fixing plate 30.

The slot magazine 50 is made with different size depending on the size of the pouch 1, and the slot magazine 50 is replaced on the turn table 40. For this, engaging projections 43 are formed to be engaged with the slide recess 42*a* of the fastener 42 on the turn table 40, and an engaging flange 54 having holes 55 in which the one-touch locking bar 41 is inserted is provided on the slot magazine 50. And aligned holes 56 are formed on the end walls and each partition 52 of the slot magazine 50. The aligned holes 56 are aligned horizontally.

The pickup means 60 is preferably made of robot arm to pick up the pouch 1 from the pouch conveyor 20 and insert it into the slot 51 of the slot magazine 50.

Figure 4:
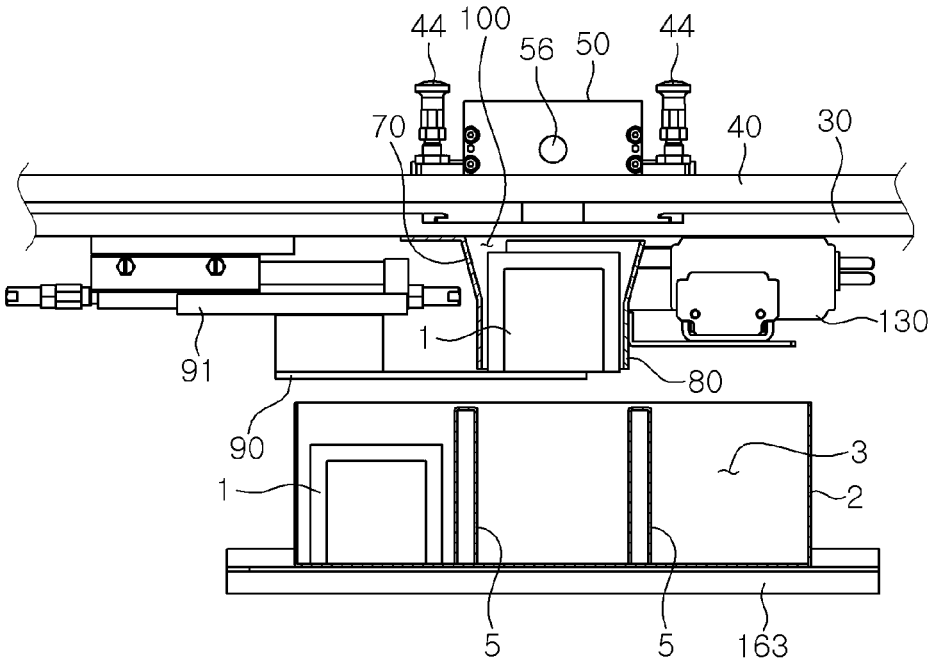
FIG. 4 is a view showing operation of the movable base plate
Figure 4:
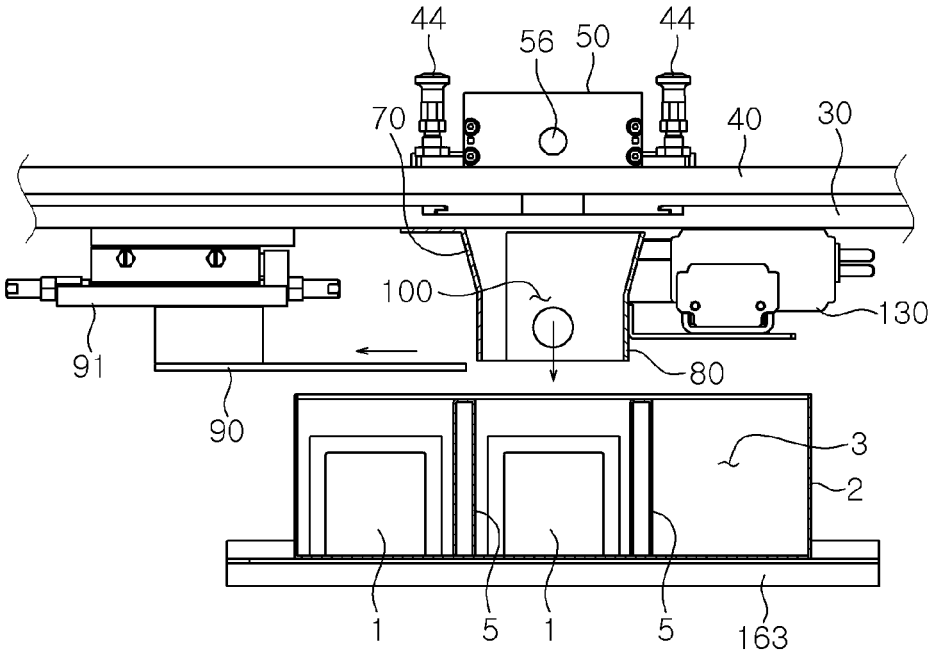
Figure 5:
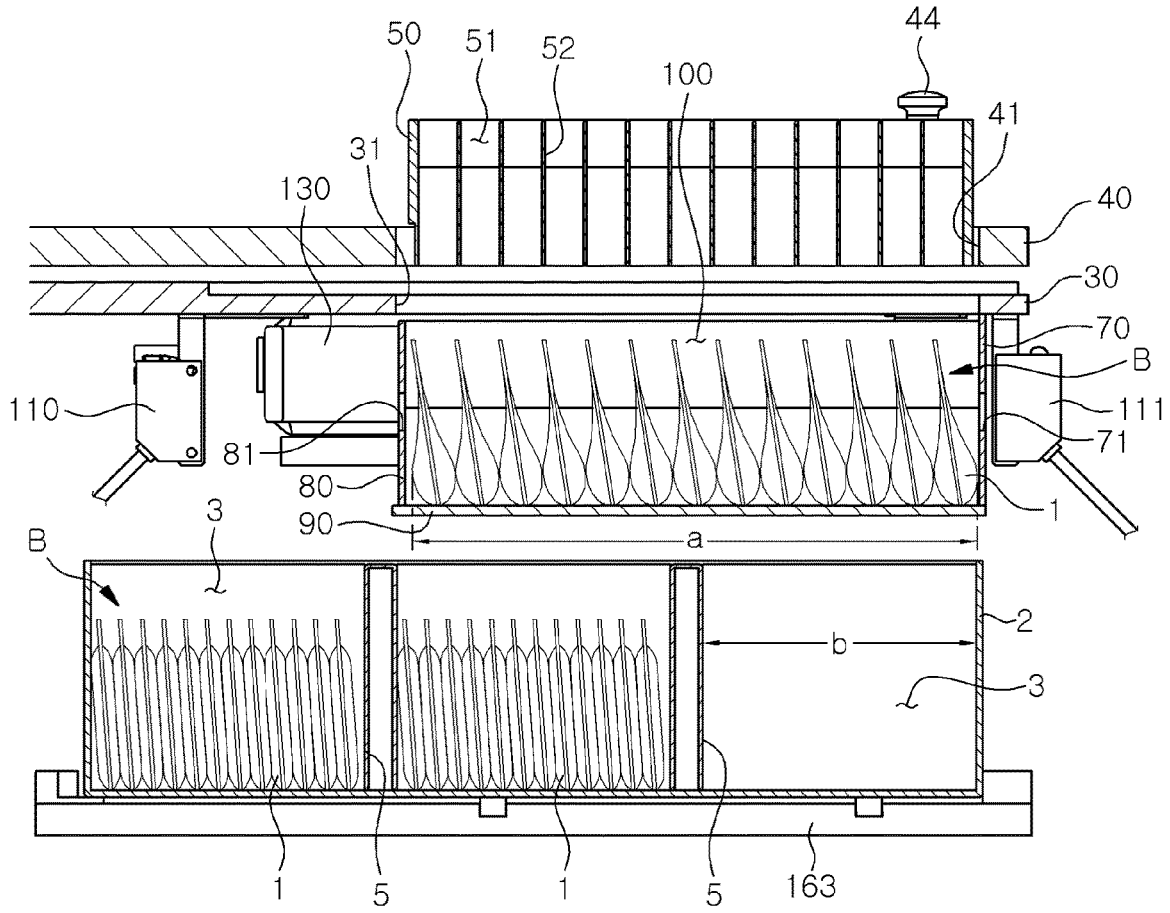
FIG. 5 is a view showing the pouch inserted in the pouch retainer

The pouch retainer 100 temporarily retains the pouch 1 dropping from each slot 51 of the slot magazine 50 before being inserted in the box 2. As shown in FIG. 5, a plurality of pouches 1 are accommodated in the pouch retainer 100 in the form of the pouch bundle B in which the pouch 1 are aligned in the thickness direction. The pouch retainer 100 has side walls 70, 80 surrounding the slot magazine 50 and a movable bottom plate 90 to open and close the lower part of the pouch retainer 100. The side walls 70, 80 regulate the position of the pouch bundle B, and in FIG. 7, comprises a pair of angle members to form a rectangular. The bottom plate 90 is movable horizontally by the opening means 90 to open and close the lower part of the pouch retainer 100. The bottom plate 90 can be moved by sliding or rotating. As shown in FIG. 4, the opening means 91 is preferably made of cylinder installed on the fixing plate 30 or base frame 10 to slide the bottom plate 90 of the pouch retainer 100.

As shown in FIG. 5, as the pouches 1 of the pouch bundle B are dropped from the narrow slot 51 of the slot magazine 50 into the pouch retainer 100, the contents in the pouches 1 may be driven downward in the pouch by their own weights, which will result in bulking of the total thickness of the pouch bundle B, and the total thickness of the pouch bundle B may be wider than the width b of the receiving recess 3 of the box 2. Therefore, the pouch bundle B is hard to be inserted in the receiving recess 3 of the box 2.

Figure 6:
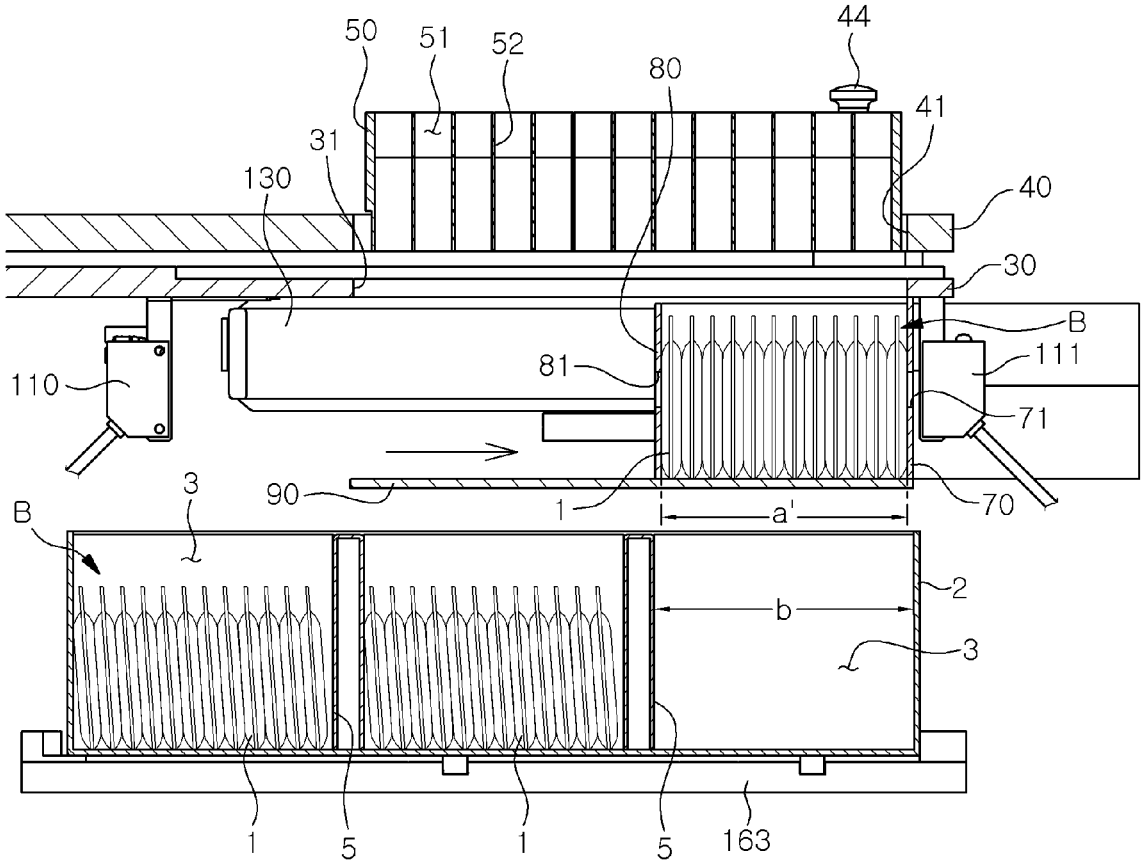
FIG. 6 is a side sectional view showing the pouch being pressed

To solve this problem, one of the two side walls 70, 80 of the pouch retainer 100 is made to be fixed wall, and the other of the side walls 70, 80 is made to be movable wall which can be moved horizontally by the moving means 130 to press the pouch bundle B in the thickness direction. The moving means 130 is preferably made of a cylinder installed on the fixing plate 30 or the base frame 10. Accordingly, as shown in FIG. 6, the moving side wall 80 may press the bulked pouch bundle B in the thickness direction to flatten the pouches 1 and reduce the total thickness a' of the pouch bundle B, so the pouch bundle B can be easily inserted in the receiving recess 3 of the box 2.

The structure of the side walls 70, 80 of the pouch retainer 100 can be changed variously. For example, four straight side walls can be installed to surround the pouch retainer 100, or one U shape side wall and one straight side wall can be combined to surround the pouch retainer 100. And the moving side wall can be positioned at one end or both ends of the pouch retainer 100. And, as shown in FIG. 4, the upper part of the side walls 70, 80 may be extended upwardly as a hopper to easily receive the pouches 1. Alternately, the two side walls 70, 80 of the pouch retainer 100 may be made to be fixed, and an additional moving plate can be installed in the pouch retainer 100 to press the pouch bundle B.

Figure 7:
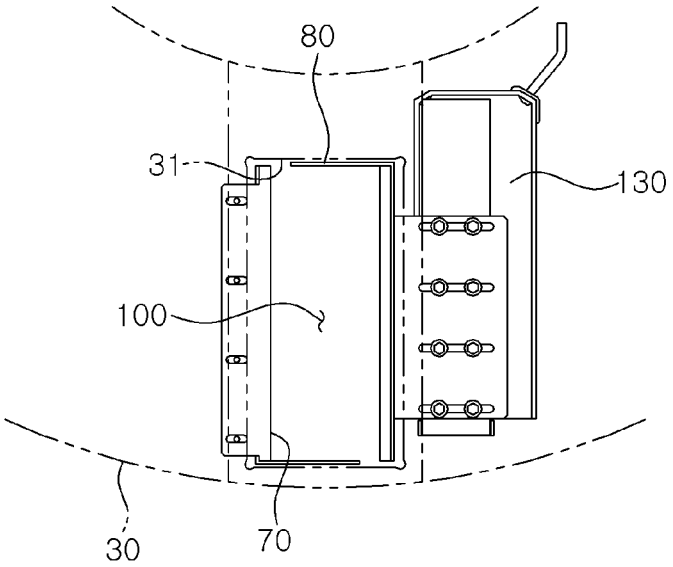
FIG. 7 is a sectional view showing the operation of moving side walls.
Figure 7:
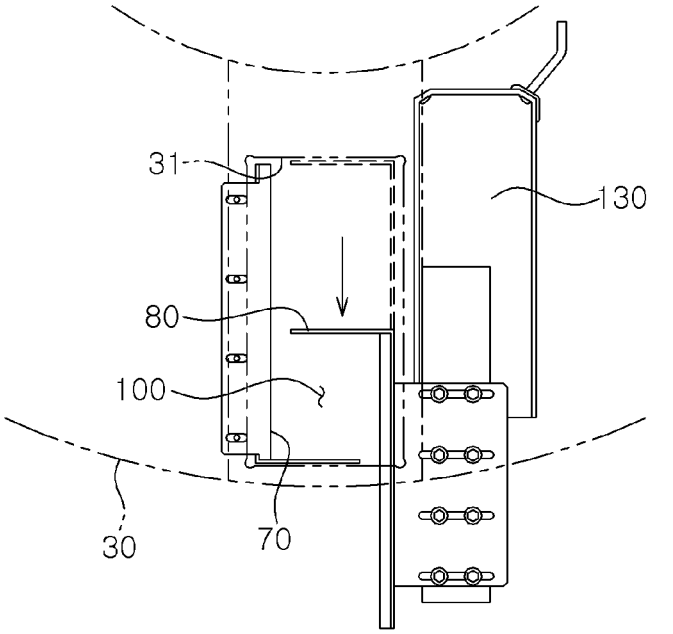

As shown in FIG. 7, the movable side wall 80 can be moved toward or from the fixed wall 70, so the size of the horizontal section of the pouch retainer 100 surrounded by the side walls 70, 80 is variable. Therefore, the size or shape of the pouch retainer 100 can be adjusted according the size or the number of the pouch, the number of the used slot, the size of box, the size or the location of receiving recess 3 of the box 2, so the apparatus of the invention can be used for various size of pouch and box.

The first sensors 110,111 detect whether the pouch 1 is inserted in the pouch retainer 100 and whether the inserted pouch 1 is exhausted from the pouch retainer 100, and send the detected signal to the controller 180, and are installed on the fixing plate 30, the side walls 70, 80 or the bottom plate 90. The first sensors 110, 111 may be weight-detecting sensor installed on the bottom plate 90, but preferably, they may be photo sensors having a light emitter 110 and a light receiver 111. As shown in FIG. 5, light holes 71, 81 are formed on the side walls 70, 80 and the light emitter 110 and the light receiver 111 are installed outside the side walls 70, 80 so that the light emitted from the light emitter 110 can pass through the light holes 71, 81 to the light receiver 111.

The second sensors 120,121 detect whether the pouch 1 picked by the pickup means 60 is regularly inserted in the slot 51 of the slot magazine 50 and send the detected signal to the controller 180. That is, before the slot magazine 50 is aligned with the pouch passing hole 31 of the fixing plate 30 by turning the turn table 40, the second sensors 120,121 detect whether the pouch 1 is regularly inserted in the slot magazine 50. If the pouch 1 is not inserted in the slot magazine 50 regularly, then the pouch 1 cannot be exhausted from the slot magazine 50.

Figure 9:
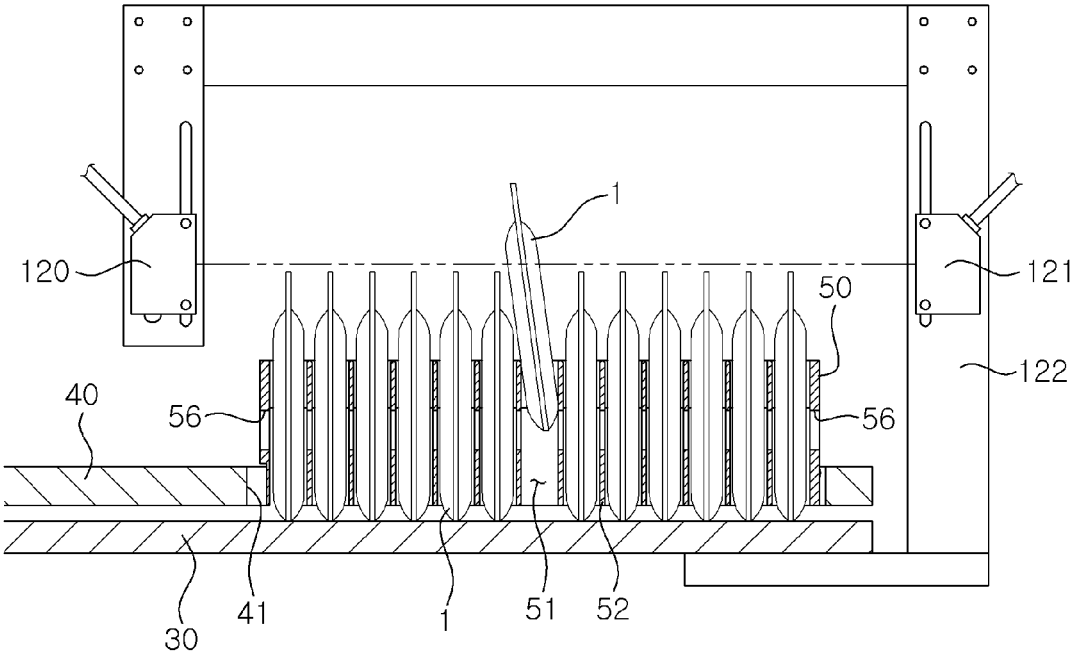
FIG. 9 is a view showing the sensors according to the invention
Figure 9:
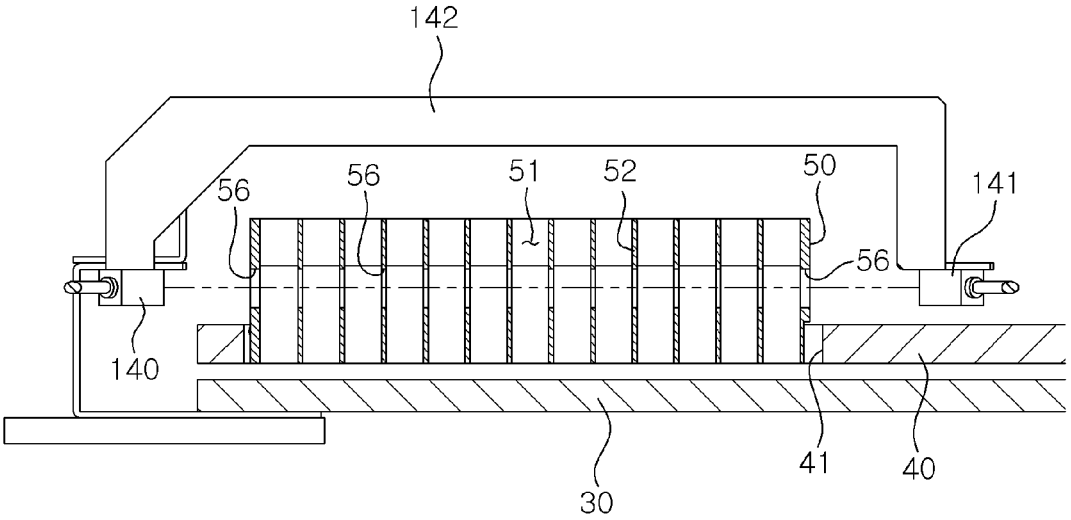

Preferably, the second sensors 120, 121 are photo sensors having a light emitter 120 and a light receiver 121. As shown in FIG. 9, the second sensors 120, 121 are installed on both end of a hanger member 122 of the fixing plate 30 or the base frame 10, the hanger member 122 being positioned above the slot magazine 50 and extending outside the both end of slot magazine 50. If the pouch 1 is irregularly inserted in the slot magazine 50, the pouch 1 will be projected from the normal position of the slot magazine 50 and it cannot be dropped from the slot magazine 50. To detect the irregular insert, the second sensors 120, 121 will be position above the slot magazine 50. If the second sensors 120, 121 detect the irregular insert of the pouch 1 as shown in FIG. 9*a*, then send the detected signal to the controller 180 and the controller 180 will generate the alarm sound or alarm message on the monitor.

The remaining amount sensor 140,141 detects the remaining pouch 1 that is not dropped after the turn table 40 is turned and the slot magazine 50 is aligned with the pouch passing hole 31 of the fixing plate 30. The remaining amount sensors 1401,141 preferably comprise of a light emitter 140 and a light receiver 141, and installed on both end of a hanger member 142 of the fixing plate 30 or the base frame 10, the hanger member 142 being positioned above the slot magazine 50 and the both ends of it is position outside the both end of the slot magazine 50 as shown in FIG. 9*b*. If the pouch 1 remained in the slot magazine 50, then the light from the light emitter 140 cannot reach the light receiver 141.

Figure 10:
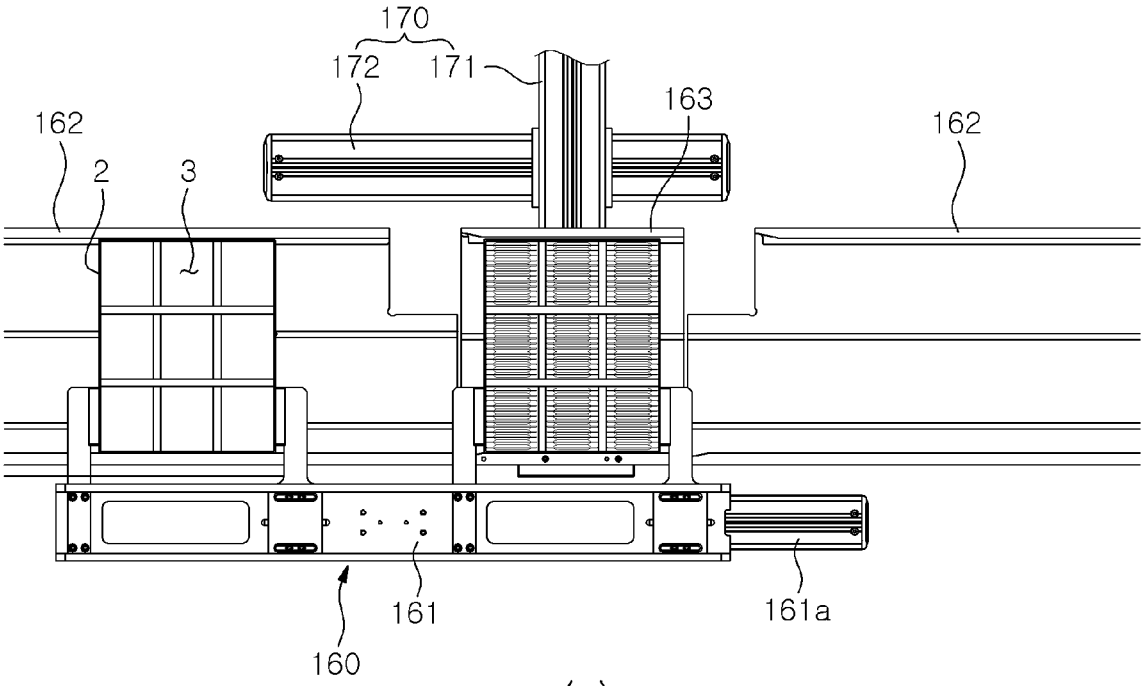
FIG. 10 is a view showing operation of box supplier according to the invention
Figure 10:
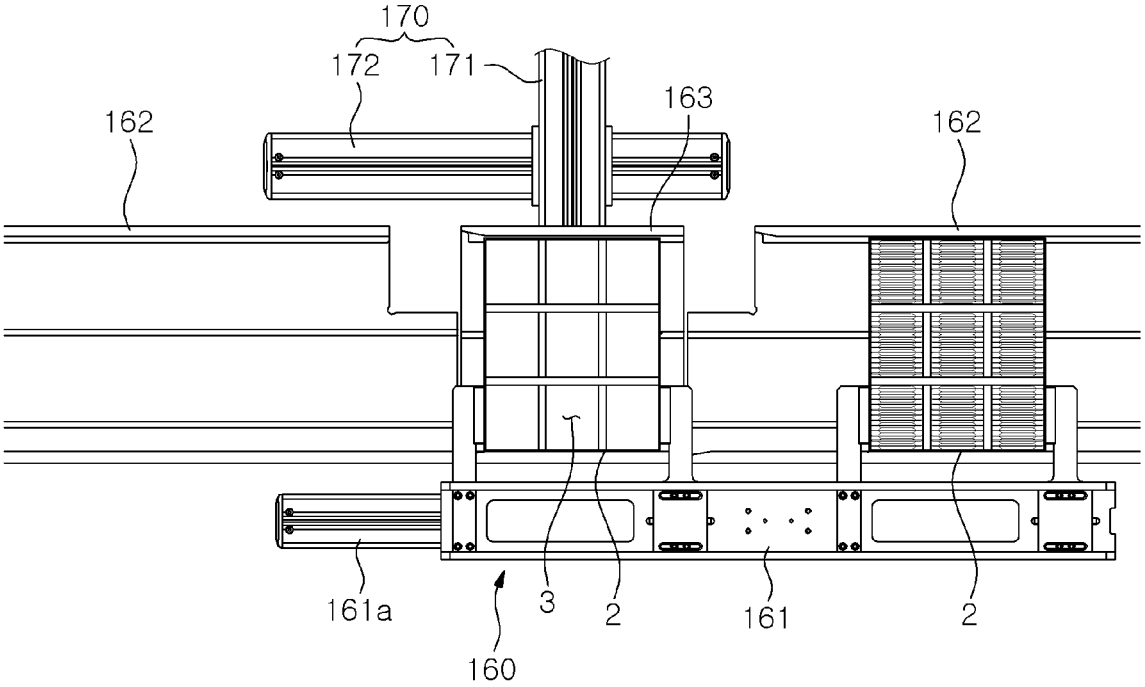

The box supplier includes a box loader 150, a box conveyor 160 and a box location adjusting means 170. The box loader 150 comprises a conveyor belt below the box magazine and transfers the box 2 onto the box conveyor 160. As shown in FIG. 10, the box conveyor 160 includes a box feeder 161, feeding rails 162 and a box tray 163. The box feeder 161 is installed movably along the feeding rail 162 to feed the box 2. The box tray 163 is disposed between the feeding rails 162. The box feeder 161 moves the box on the feeding rail 162 to the box tray 163 or to the adjacent feeding rail 162. The box tray 163 can be moved by the box location adjusting means 170 as mentioned below.

Figure 11:
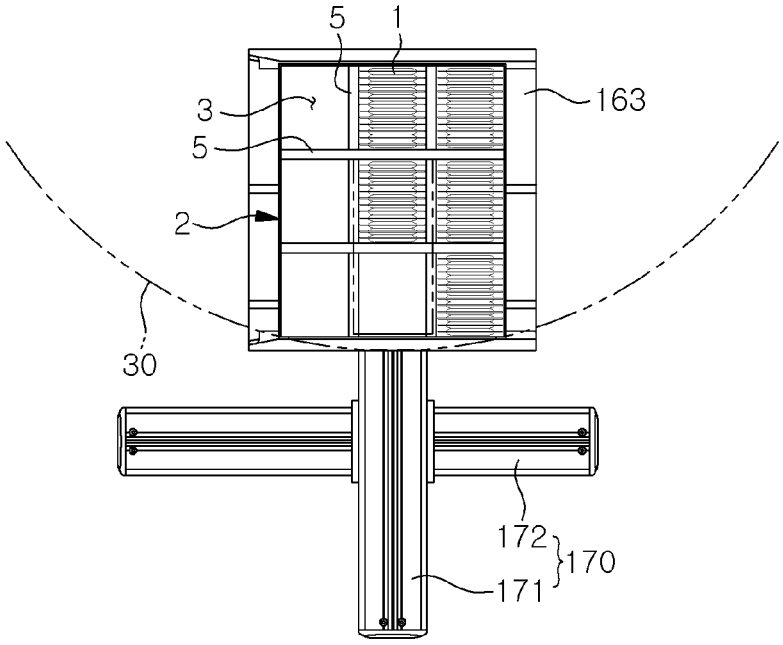
FIG. 11 is a view showing operation of the box location adjusting means 170
Figure 11:
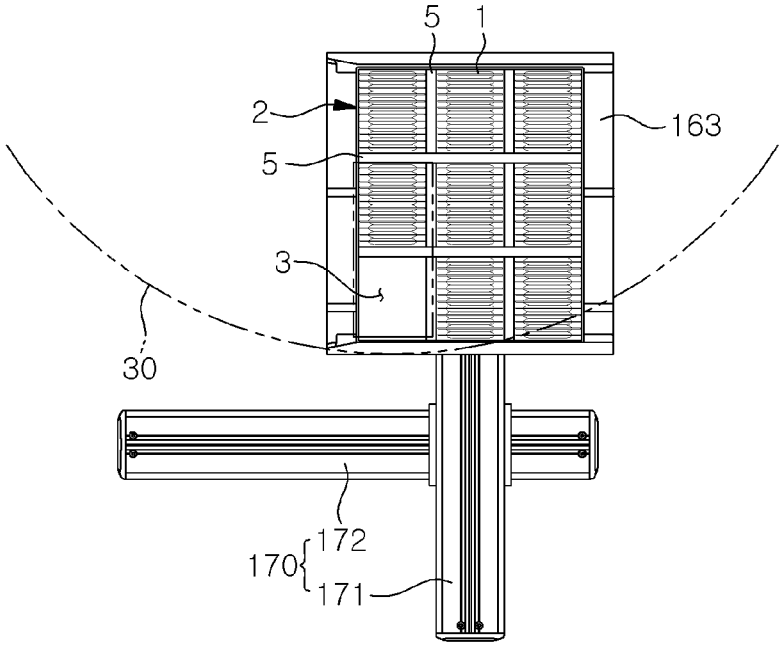

The box location adjusting means 170 moves the box 2 from the box conveyor 160 to the position below the turn table 30 and the pouch retainer 100, and adjusts the location of the box 2 or the receiving recess 3 of the box 2 to be aligned with the box retainer 100. As shown in FIG. 11, the box location adjusting means 170 includes a first axial member 171 to move the box tray 163 to the position below the turn table 40, and a second axial member 172 traversing to the first axial member 171. The feeding pitch of the first axial member 171 and the box tray 163 are precisely controlled by the controller 180. If the box location adjusting function is not provided, then the box 2 is to be directly fed to the positon below the turn table 40.

Meanwhile, a lid removing means 164 is installed on the entry of the box conveyor 160 to remove the lid 4 from the box 2, and a lid covering means 165 is installed on the opposite end of the box conveyor 160. The lid removing means 164 and the lid covering means 165 are preferably made of vacuum pads. A lid conveyor 166 is provided between the lid removing means 164 and the lid covering means 165. A process of inputting the instruction sheet into the box 2 can be added before the lid covering process.

The controller 180 controls the operations of the pouch conveyor 20, the turn table 40, the pickup means 60, the moving means 130, the opening means 91, the box loader 150, the box conveyor 160, the box location adjusting means 170, the lid removing means 164, the lid covering means 165, the lid conveyor 166, the first sensor2 111, 111, the second sensors 120, 121 and the remaining amount sensors 140, 141. The box location adjusting means 170 comprises robot arms. The moving means 130 and the opening means 91 are preferably robots operated sequentially by the program.

The operation of the auto-packing apparatus for pouch according to the invention will be described below.

As shown in FIG. 1, the pouches 1 are supplied through the pouch conveyor 20, and the pickup means 60 picks up the pouches 1 and inserts them into each slots 51 of the slot magazine 50 on the turn table 40. Then, the boxes 2 are supplied by the box supplier to the position below the pouch retainer 100, and as shown in FIG. 10 and FIG. 11, the receiving recess 3 of the box 2 is aligned with the pouch retainer 100 by the box location adjusting means 170.

Figure 2:
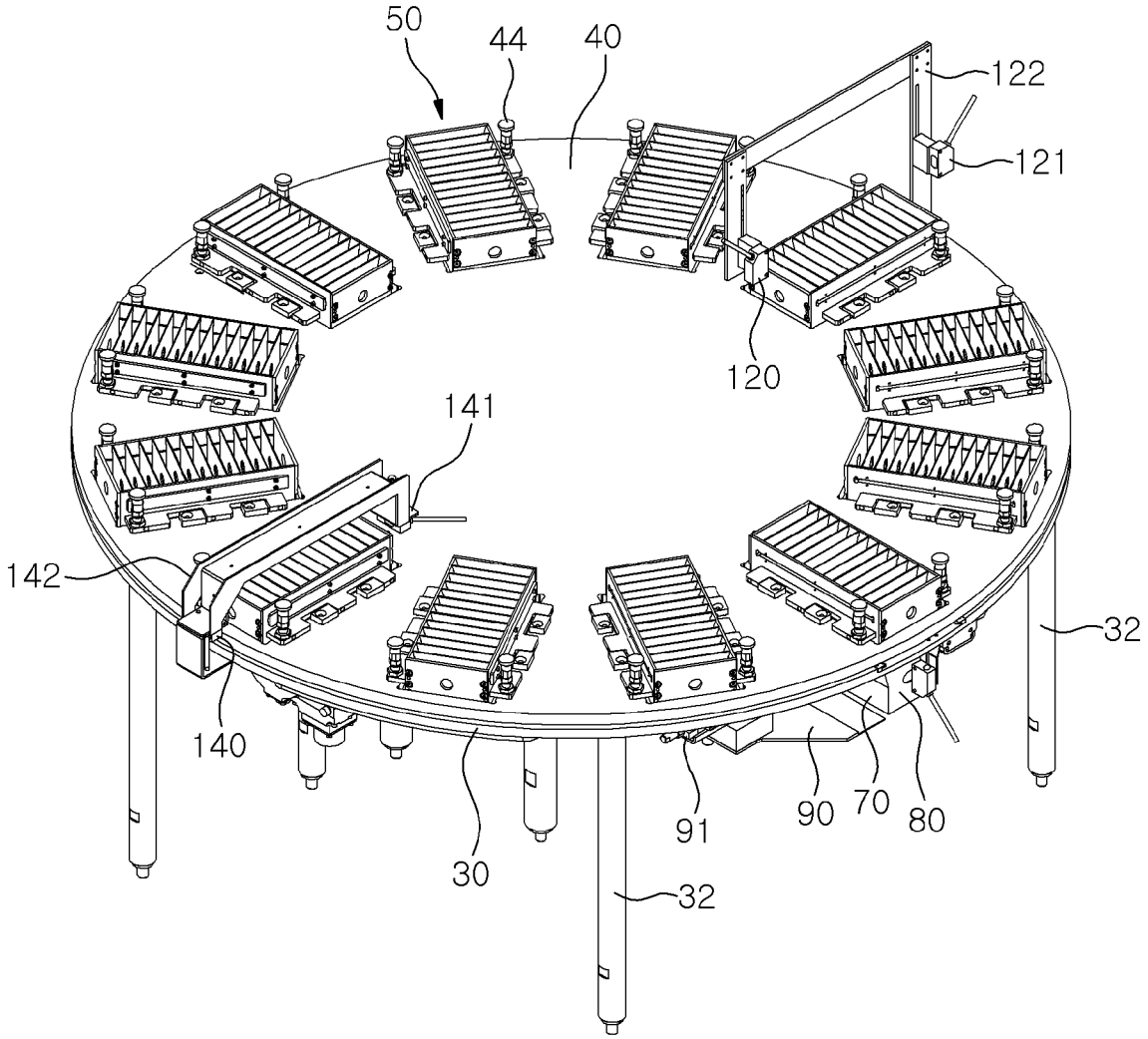
FIG. 2 is a view showing the turn table according to the invention

Meanwhile, as shown in FIG. 2 and FIG. 9, the turn table 40 is turned and the second sensors 120, 121 detect whether the pouch 1 is regularly inserted in the slot magazine 50, and if it is detected that the pouch 1 is irregularly inserted, then alarm sound or alarm message is generated, and the worker may manually insert the pouch 1 into the slot magazine 50 properly.

And, as the turn table 40 is turned, and the slot magazine 50 containing the pouches 1 is aligned with the pouch passing hole 31 of the fixing plate 30, the pouches 1 in the slot magazine 50 are dropped through the pouch passing hole 31 into the pouch retainer 100, as shown in FIG. 5. At this time, as shown in FIG. 7, the moving side wall 80 of the pouch retainer 100 can be moved according to the size and location of the pouches 1 in the slot magazine 50 to change the size of the pouch retainer 100. Meanwhile, as the pouch 1 gets out of the slot 51, the thickness of the lower part of the pouch 1 becomes bulked or expanded as the contents in the pouch are driven downward, and the total thickness (a) of the pouch bundle B may be larger than the width (b) of the receiving recess 3 of the box 2.

Figure 8:
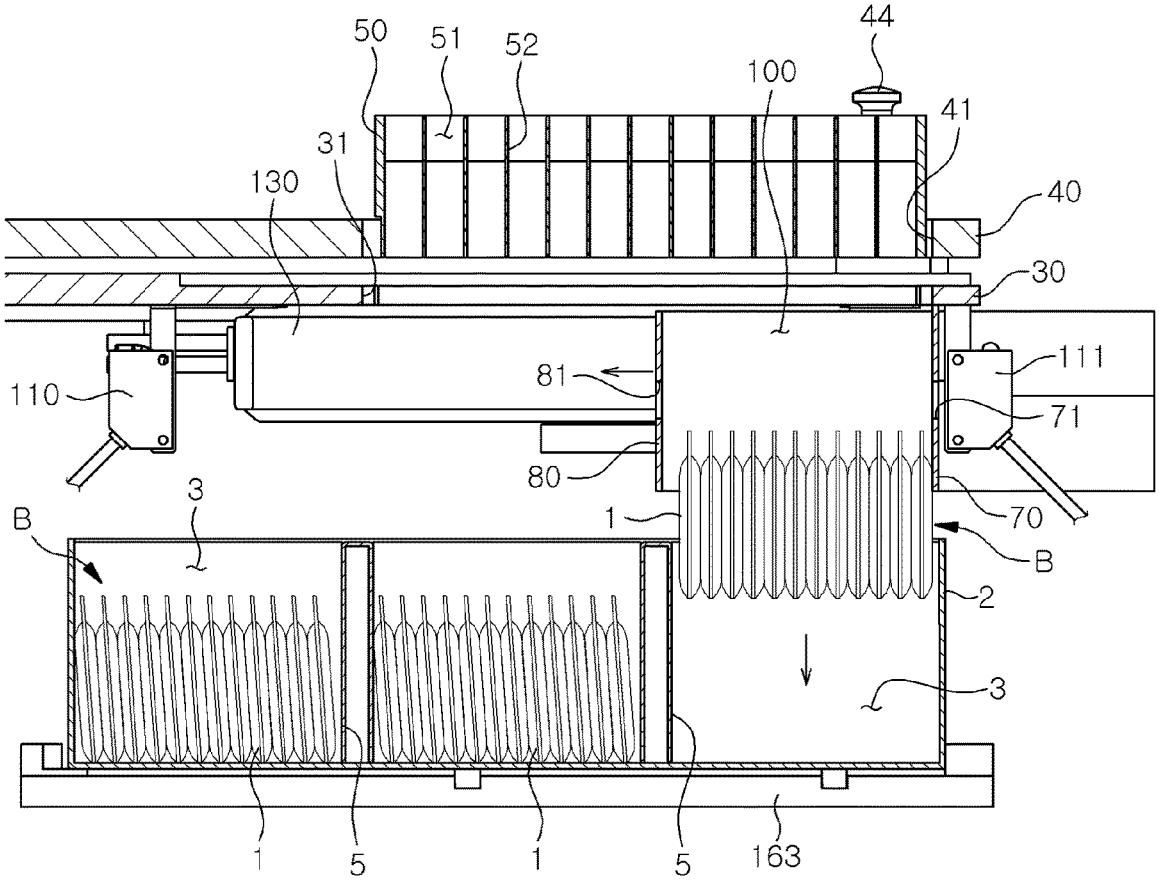
FIG. 8 is a view showing the pouch being inserted in the box

As shown in FIG. 5, if the first sensors 110, 111 detect that the pouches 1 is inserted in the pouch retainer 100, the movable side wall 80 is moved to press the pouch bundle B in the pouch retainer 100 in the thickness direction. Accordingly, the contents in the pouch 1 are uniformly dispersed in the pouch 1 and the pouch 1 becomes flatten. Then the total thickness a' of the pouch bundle B becomes narrower than the width (b) of the receiving recess 3 of the box 2. Then the movable bottom plate 90 is retreated to open the lower part of the pouch retainer 100, as shown in FIG. 8, and the movable side wall 80 is also retreated, then the pouches 1 are released from pressed state and dropped into the box 2 disposed below the pouch retainer 100. Then the first sensors 110, 111 detect whether the pouch 1 remains in the pouch retainer 100.

After pouch inserting of one receiving recess 3 of the box 2 is completed, the location of the receiving recess 3 is adjusted for other receiving recess 3 to be aligned with the pouch retainer 100 by the box location adjusting means 170. And the turn table 40 is turned and another slot magazine 50 containing the pouches 1 is aligned with the pouch passing hole 31 of the fixing plate 30, then the pouches 1 are inserted in the pouch retainer 100, and the pouch bundle B is pressed to be flatten and dropped into the receiving recess 3 of the box 2.

Referring FIG. 2, two turn tables 40 are provided on the base frame 10. In this embodiment, it is preferable that the pouch inserting into one box 2 should be carried out by two turn tables 40. For example, only three receiving recesses 3 out of 6 receiving recesses 6 should be inserted by the first turn table 40 by being moved along the second axial member 172 of the box location adjusting means 170, then the box 2 is moved to the position below the second turn table 40, and the other three receiving recesses 3 should be inserted by the second turn table 40 with the similar manner.

In the above embodiment of the invention, the slot magazine 50 is described to be moved by the turn table 40, but other moving means such as conveyor can be adopted to move the slot magazine 50. Or the slot magazine 50 can be installed on the fixed table.

Figure 12:
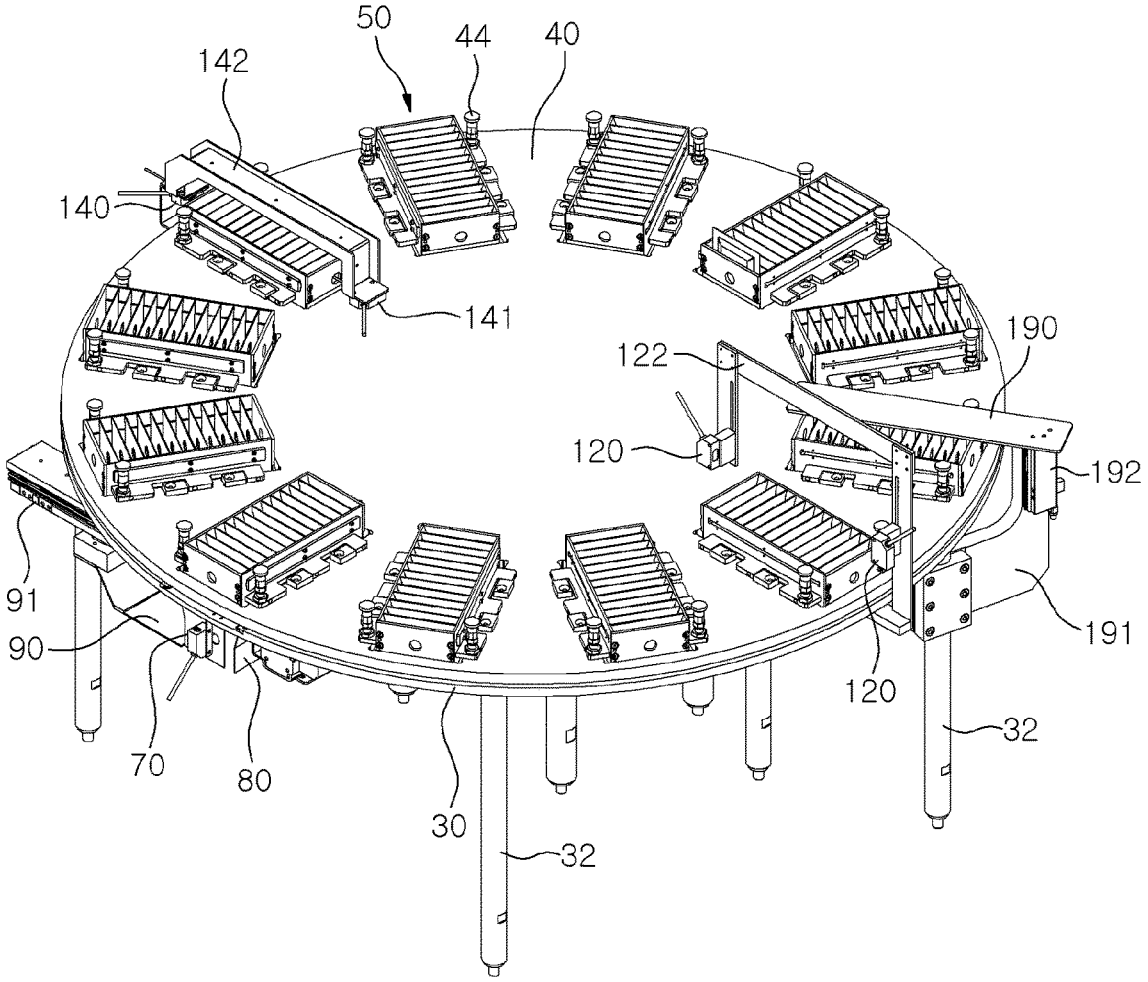
FIG. 12 is a view of the other embodiment of the invention
Figure 13:
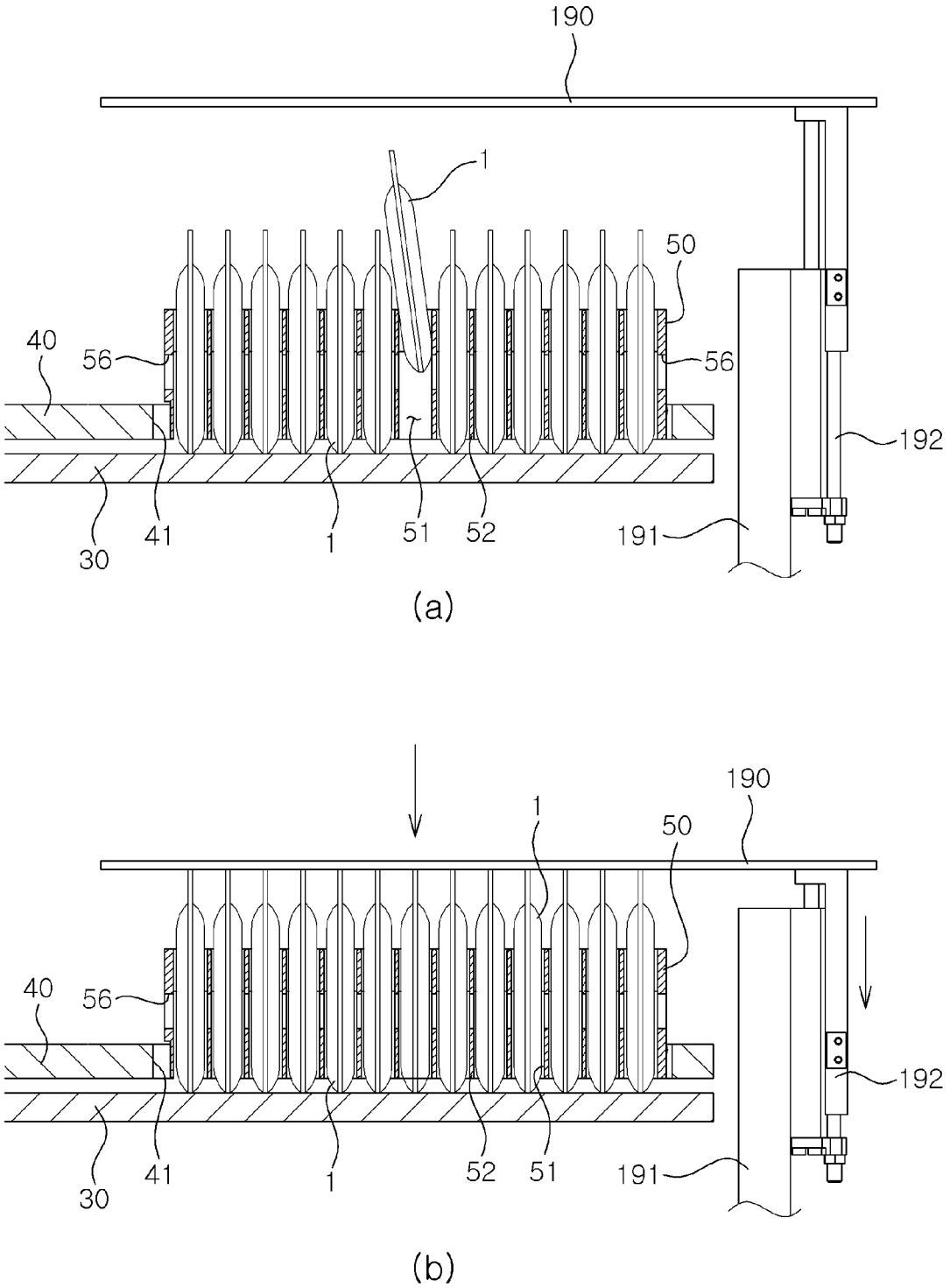
FIG. 13 is a view showing operation of pouch pusher of FIG. 12.

FIG. 12 and FIG. 13 show the other embodiment of the invention, in which a pouch pusher 190 is further provided to push down the pouch 1 into the slot magazine 50. This pouch pusher 190 is installed on the bracket 191 mounted on the fixing plate 30 or base frame 10 and it can be moved up and down by a cylinder 192. The pouch pusher 190 is in the shape of strip extending along the slot magazine 50, and is disposed adjacent to the first sensors 110, 111.

If the pouch 1 is irregularly inserted in the slot magazine 50, as shown in FIG. 13*a*, then the pouch pusher 190 is moved downward to push down the pouch 1 so that the pouch 1 becomes regularly inserted in the slot magazine 50. Without the pouch pusher 190, the restoring of the irregular insertion should be carried out by manual work. With the pouch pusher 190, the restoring of the irregular insertion can be carried out automatically, so the full automatic pouch packing is possible.

The invention claimed is:

1. An auto-packing apparatus, which can insert pouches with flat shape into a receiving recess of a box, wherein the apparatus comprises:

a pouch conveyor which conveys pouches;

a slot magazine disposed on one side of the pouch conveyor and above the box and having a plurality of slots on an upper surface into which the pouches can be inserted vertically;

a pickup disposed on another side of the pouch conveyor configured to pick up the pouches on the pouch conveyor and insert the pouches into the slots of the slot magazine;

a pouch retainer disposed between the slot magazine and the box and having side walls surrounding the slot magazine and a movable bottom plate to open and close a lower part of the pouch retainer to retain the pouches dropping from the slot magazine;

a mover configured to move one of the side walls of the pouch retainer or other moving plate horizontally to press a pouch bundle consisting of the pouches after alignment in a thickness direction;

an opener configured to slide or swing the movable bottom plate to open and close the lower part of the pouch retainer;

a controller to control operation of the mover and the opener, a fixing plate disposed on the one side of the pouch conveyor and above the box and having a pouch passing hole on the surface of the fixing plate, and the pouch retainer being attached under the pouch passing hole;

a turn table disposed on the fixing plate and having an opening on which the slot magazine is mounted, the opening being aligned with the pouch passing hole of the fixing plate when the turn table is turned; and a box supplier supplying the box so that the receiving recess of the box is aligned with the pouch retainer.

2. The auto-packing apparatus of claim 1, wherein the pouch retainer has first sensors detecting whether the pouches are inserted in the pouch retainer and whether the pouches are exhausted from the pouch retainer, or second sensors detecting whether the pouches are regularly inserted in the slot of the slot magazine.

3. The auto-packing apparatus of claim 1, wherein the receiving recess of the box is partitioned by a partition wall, and a box supplier further includes a box location adjuster to adjust a location of the receiving recess of the box to be aligned with the pouch retainer.

4. The auto-packing apparatus of claim 1, wherein the pouch retainer has first sensors detecting whether the pouches are inserted in the pouch retainer and whether the pouches are exhausted from the pouch retainer, or second sensors detecting whether the pouches are regularly inserted in the slot of the slot magazine.

5. The auto-packing apparatus of claim 1, wherein the receiving recess of the box is partitioned by a partition wall, and a box supplier further includes a box location adjuster to adjust a location of the receiving recess of the box to be aligned with the pouch retainer.

* * * * *